US009174825B2

(12) United States Patent
Bloch

(10) Patent No.: US 9,174,825 B2
(45) Date of Patent: Nov. 3, 2015

(54) ELEVATOR

(71) Applicant: INVENTIO AG, Hergiswil NW (CH)

(72) Inventor: Hanspeter Bloch, Buchrain (CH)

(73) Assignee: Inventio AG, Hergiswil (CH)

( * ) Notice: Subject to any disclaimer, the term of this patent is extended or adjusted under 35 U.S.C. 154(b) by 310 days.

(21) Appl. No.: 13/628,838

(22) Filed: Sep. 27, 2012

(65) Prior Publication Data

US 2013/0092479 A1 Apr. 18, 2013

(30) Foreign Application Priority Data

Oct. 13, 2011 (EP) ..... 11184983

(51) Int. Cl.
*B66B 11/02* (2006.01)
*B66B 5/00* (2006.01)

(52) U.S. Cl.
CPC ..... *B66B 5/0081* (2013.01)

(58) Field of Classification Search
CPC ..... B66B 5/0081; B66B 11/0226; E04G 21/3223; E04G 21/3233; Y10S 256/06
USPC ..... 187/401; 256/59; 182/113
See application file for complete search history.

(56) References Cited

U.S. PATENT DOCUMENTS

| | | | | | |
|---|---|---|---|---|---|
| 3,740,022 | A * | 6/1973 | DiGiovanni | 256/24 |
| 3,776,521 | A * | 12/1973 | Weinert | 256/24 |
| 4,236,698 | A * | 12/1980 | Compte | 256/23 |
| 4,856,761 | A * | 8/1989 | Berner | 256/59 |
| 4,989,689 | A * | 2/1991 | Berlin | 182/45 |
| 5,188,342 | A * | 2/1993 | Ouellette et al. | 256/65.08 |
| 5,237,932 | A * | 8/1993 | Edwards | 104/124 |
| 5,263,550 | A * | 11/1993 | Jines et al. | 182/113 |
| 5,667,199 | A * | 9/1997 | Hamm | 256/67 |
| 6,039,150 | A * | 3/2000 | Palmer | 182/113 |
| 6,543,584 | B1 * | 4/2003 | Miyakoshi et al. | 187/401 |
| 7,140,473 | B2 * | 11/2006 | Det et al. | 187/401 |
| 7,281,609 | B2 * | 10/2007 | Del Rio Sanz et al. | 187/316 |
| 7,510,056 | B2 * | 3/2009 | Bonatre | 187/401 |
| 8,028,808 | B2 * | 10/2011 | Gonzalez Rodil et al. | 187/391 |
| 8,365,870 | B2 * | 2/2013 | Sirigu et al. | 187/306 |
| 2002/0170783 | A1 * | 11/2002 | Goode | 187/240 |
| 2005/0252726 | A1 * | 11/2005 | Det et al. | 187/401 |
| 2010/0252792 | A1 * | 10/2010 | Bennett | 256/21 |
| 2011/0138700 | A1 * | 6/2011 | Grimaldi | 52/71 |
| 2012/0031712 | A1 * | 2/2012 | Bloch et al. | 187/401 |
| 2012/0186909 | A1 * | 7/2012 | Chilton | 182/113 |
| 2012/0325582 | A1 * | 12/2012 | Bloch | 182/129 |
| 2013/0092479 | A1 * | 4/2013 | Bloch | 187/401 |

FOREIGN PATENT DOCUMENTS

| | | | |
|---|---|---|---|
| EP | 0926093 | A1 | 6/1999 |
| JP | 2008-110863 | A | 5/2008 |
| JP | 2011-037586 | A | 2/2011 |
| WO | 03/095350 | A1 | 11/2003 |

* cited by examiner

*Primary Examiner* — Sang Kim
*Assistant Examiner* — Michael Riegelman
(74) *Attorney, Agent, or Firm* — Fraser Clemens Martin & Miller LLC; William J. Clemens

(57) ABSTRACT

A car for an elevator, which is movable in an elevator shaft, has a car roof projecting at least partly beyond a drive unit. Arranged on the car roof in the region of the side facing the drive unit is a balustrade which has a handrail interrupted centrally in a drive receiving region. The balustrade has in the drive receiving region a bar which is arranged to be offset downwardly and inwardly relative to the handrail.

18 Claims, 3 Drawing Sheets

ELEVATOR

FIELD

The invention relates to an elevator. Elevators include cars which are movable up and down in an elevator shaft by means of a drive unit by way of support means in the form of, for example, support cables or support belts. For some time, so-called engine-room-less elevators have enjoyed increasing popularity. These are elevator installations in which the drive units are arranged no longer in a separate engine room, but in the elevator shaft. The drive unit is in that case usually positioned at the top, i.e. in the region of the shaft head of the elevator shaft.

BACKGROUND

For specific situations such as, for example, maintenance operations or inspections it is necessary for persons to stand on the elevator car roof. If the width of the gap between the car and the adjoining shaft wall is too large, protective devices for protection against falling down have to be installed on the car roof. For example, European Norm EN 81-1: 1998 contains instructions with detailed specifications for the design and dimensioning of the car roof and the necessary protective device.

An elevator without an engine room and with a drive unit projecting partly beyond the car has become known from EP 926 093 A1, in which specifications in the nature of EN 81-1: 1998 have been realized. A balustrade (railing) is arranged on the car roof to be offset inwardly to such an extent from the roof edge that it is arranged, apart from the overlap region or projected shadow, between drive and car roof. This arrangement of the balustrade has a negative influence on the space available for persons.

SUMMARY

It is accordingly an object of the present invention to avoid the disadvantages of the prior art and, in particular, to create an elevator with an optimized availability of space on the car roof.

The balustrade can be arranged on the car roof adjacent to a roof edge in the region of the side facing the drive unit. Due to the fact that the balustrade has a handrail which is interrupted preferably approximately centrally, optimum utilization of the shaft height can be made. With the design of the balustrade according to the invention upper travel positions of the car are made possible in which a lower end of the drive unit lies deeper than the handrail. In such an extreme position the drive unit could protrude downwardly of the handrail with respect to a side view.

The balustrade can be arranged on the car roof directly adjoining the roof edge. However, favorable space conditions can also be achieved if the respective balustrade is arranged on the car roof in the overlap region between drive unit and car roof. The mentioned overlap region corresponds with the projected shadow or the vertical projection of the drive unit on the car roof. The elevator comprises a bar, which is arranged to be offset downwardly relative to the handrail, at least in the drive receiving region, which is created by the interruption of the handrail, for reception of the drive unit. The bar thus ensures a minimum protection against falling down for persons on the car roof.

In safety-engineering respects it can also be advantageous if the bar is arranged to be offset inwardly relative to the handrail. In this way, the risk of injury for persons, who are on the car roof and who during upward movement of the car into the region of the shaft head walk out from the drive unit, can be reduced. In that case, with particular preference the bar is arranged at least in the drive receiving region to be offset inwardly to such an extent that it no longer lies in the overlap region between drive unit and car roof. Inwardly, in that case means directed towards the center of the car roof or in the direction of the shaft wall opposite the shaft wall associated with the drive unit.

In a further form of embodiment the balustrade can preferably comprise at least one intermediate rod approximately at half the height of the handrail. The bar can extend at least in a section along a straight line parallel to the intermediate rod. The balustrade can have an intermediate rod which is continuous or extends over the entire width of the reinforcing device. However, it can be particularly advantageous if the intermediate rod—in similar or same mode and manner as the handrail—is interrupted preferably centrally. The balustrade can thus comprise, with particular preference, respective intermediate rods on either side of the drive receiving region. The bar can extend at least in a section along a straight line spaced from the intermediate rod. In that case the bar can be spaced in vertical direction and/or in horizontal direction from the intermediate rod or from a straight line predetermined by the intermediate rod, The balustrade can have a respective inner and outer post on either side near the drive receiving region. In that case, a respective handrail section of the handrail can extend from one inner post to one outer post or connect the posts together. The outer posts can advantageously be arranged on the car roof in corner regions. The space between the two inner posts can determine the drive receiving region. The bar can be fastened to the outer posts. It would inherently additionally also be conceivable to fasten the bar similarly to the inner posts, whereby a more stable and additionally stiffened structure for protection against falling down would be obtained. However, it would intrinsically be also conceivable to provide a shorter bar. In this case the horizontally extending bar would merely connect the two inner posts together.

The bar can be respectively connected with the outer and/or inner posts by way of spacers extending preferably approximately at right angles to the bar. In this way the bar can be arranged to be offset inwardly relative to the handrail in particularly simple manner.

If the elevator comprises support means—which are in operative connection with the drive unit and which are guided in vertical direction along a shaft wall associated with the drive unit—for supporting the car, it can be advantageous if the drive receiving region faces the support means by the bar offset downwardly relative to the handrail and covers (with respect to a front view of the protective device) the support means. Tests and experiments with models have shown that the support means together with the bar ensure sufficient protection from falling down even in the drive receiving region.

If the elevator comprises at least one guide rail, which is arranged at the shaft wall associated with the drive unit, for guiding the car and/or a counterweight the safety for maintenance personnel can be further increased if the drive receiving unit covers the guide rail at the drive side.

A further aspect of the invention relates to a car for an elevator according to the foregoing description.

DESCRIPTION OF THE DRAWINGS

Further individual features and advantages of the invention are evident from the following description of embodiments and from the drawings, in which.

DETAILED DESCRIPTION

Figure 1:
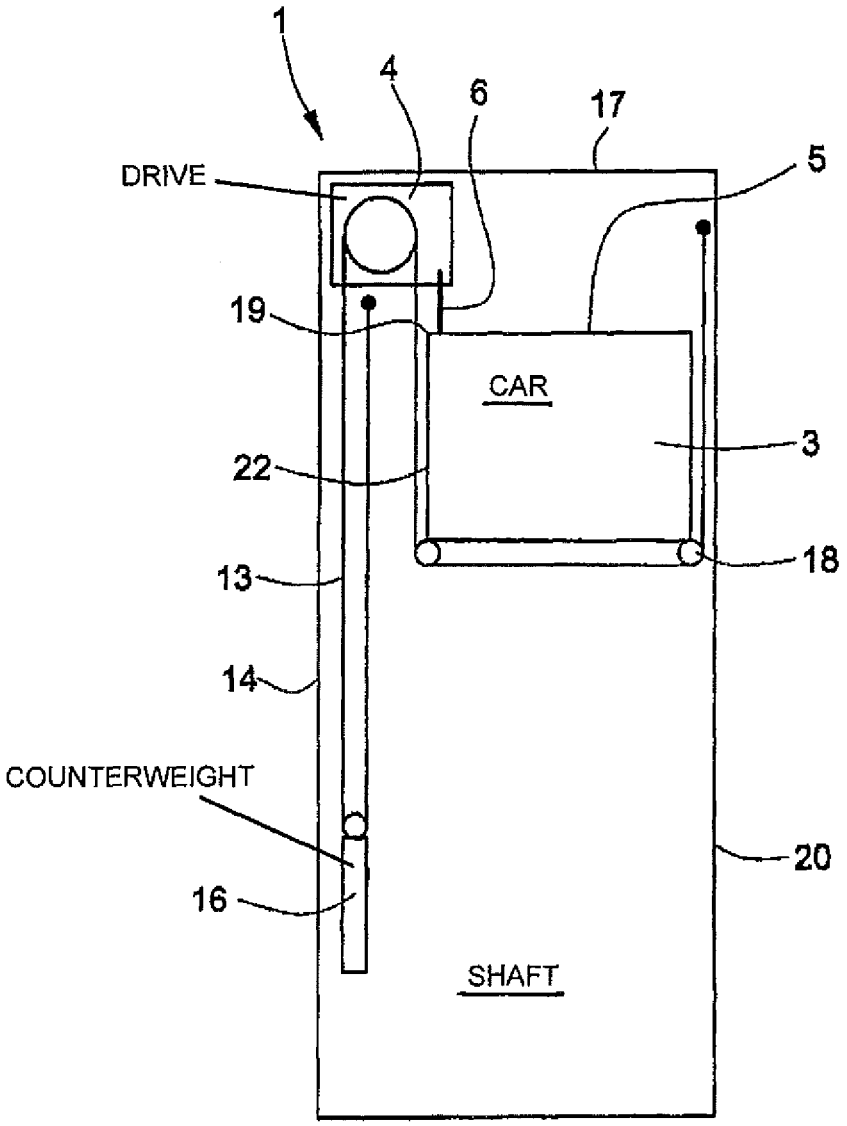
FIG. 1 shows a strongly simplified illustration of an elevator car in a side view.

FIG. 1 shows an elevator, which is without an engine room and which is denoted overall by 1, for a building. The elevator 1 includes an upwardly and downwardly movable car 3 for the transport of persons or articles. The movement of the car 3 takes place, by way of example, via support means which are designated by 13 and which support the car 3 in the form of an under-looping and by way of a 2:1 suspension. Support means 13 can be, for example, one or more support cables or support belts. However, other suspension configurations would obviously also be conceivable. The drive unit 4 for moving the car is positioned at the shaft wall, which is designated by 14, in the region of the shaft head 17. The drive unit 4 is in that case preferably fastened to the shaft wall designated by 14. The drive unit 4 comprises, by way of example, a drive pulley rotatable by way of an electric motor. The support means 13 are, as is apparent, guided over deflecting rollers 18 around the car 3. In FIG. 1 there is additionally illustrated a counterweight 16 connected with the car 3 by way of the support means 13. Illustration of further components of the elevator, such as, for example, guide rails for guiding the counterweight and the car, control means for activating or regulating the drive, were dispensed with for reasons of improved clarity.

A comparatively large gap space is formed between the car side wall 22 at the drive side and the shaft wall at the drive side and designated by 14, for which reason a balustrade designated by 6 is to be arranged on the car roof 5 in the region of the side associated with the drive unit 4 as protection against failing down. As is apparent, the drive unit 4 partly projects beyond the car 3. The part of the drive unit 4 projecting beyond the car forms an overlap region (or shadow projection in vertical direction) on the car roof 5. Disposed within this overlap region is the balustrade 6, which is preferably positioned as close as possible to a roof edge 19. The balustrade 6 comprises a handrail which is interrupted approximately centrally in a drive receiving region (not able to be seen in the view according to FIG. 1) for reception of the drive unit 4. The balustrade 6 has in the mentioned drive receiving region created by the interruption a bar arranged to be offset downwardly relative to the handrail. In the illustration according to FIG. 1 the car 3 is located in an upper extreme position near the shaft head 17. Through the downwardly offset bar there results a form of indentation in the balustrade for partial reception of the drive unit. A high car position of that kind is possible only thanks to the special design of the balustrade 6 still to be described in the following.

The region of the car roof 5 at the inside near the balustrade 6 is designed to be able to walked on by persons for maintenance operations or inspection journeys. Due to the comparatively small gap width in the case of the opposite shaft wall 20 a balustrade is not required on this side. Depending on the respective dimensioning of the shaft and the car it would be possible to mount preferably conventional protective devices, for example according to EN 81-1: 1998, on the car roof in the region of the other roof edges, for example on the opposite side, if so required.

Figure 2:
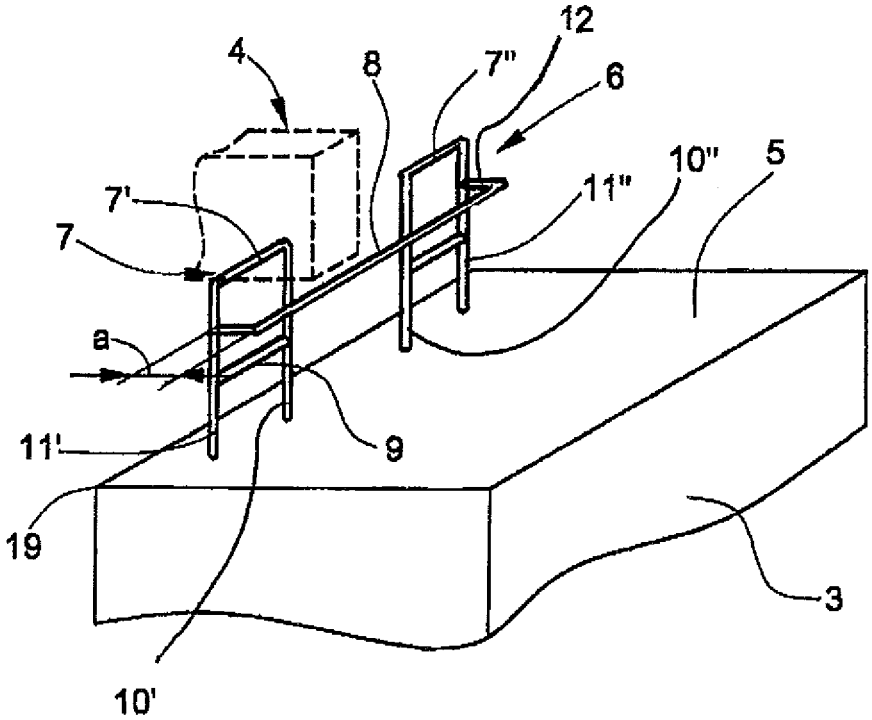
FIG. 2 shows a simplified perspective illustration of a car roof of a car for an elevator according to the invention.

The basic construction and function of the balustrade according to the present invention can be seen from the simplified perspective illustration according to FIG. 2. The individual posts and rods of the balustrade are, for the sake of simplicity, illustrated as dashed lines. In practice, the individual elements of the protective device, i.e. the posts and rods, are formed by, for example, hollow sections (for example four-sided tubes) of metal (for example steel) or other materials.

The balustrade extending along the roof edge 19 at the drive side comprises a handrail 7 consisting of handrail sections denoted by 7' and 7". The respective handrail sections 7', 7" are fastened to inner and outer posts 10', 11' or 10", 11" and bridge over the spacing between the posts. The handrail 7 is interrupted in the drive receiving region for reception of the drive unit 4 so that at least in an uppermost extreme position the drive unit 4, which is indicated by dashed lines, is received in the indentation created by the interruption of the handrail. The drive unit 4 during upward movement of the car to an uppermost position can thus move past the handrail 7.

The balustrade comprises on either side of the drive receiving section two respective vertical posts. The respective posts are denoted on one side near the drive receiving section by 10' and 11' and on the other side by 10" and 11". The respective part balustrade includes an upper handrail section 7' or 7". Respective intermediate rods 9 are disposed between the individual posts at approximately half height. A horizontally extending bar 8 is fastened to the outer posts 11' and 11" and is arranged to be inwardly offset relative to the handrail 7 by a spacing a. Spacers 12 connected at a right angle are arranged at both ends of the bar 8. The horizontal intermediate rods 9 extend parallel to the bar 8. The bar 8 has spacers 12, which extend with respect thereto at right angles to the bar and by way of which the bar is connected with the outer posts 11', 11". The bar 8 can be fastened to the posts by, for example, welding or by means of screws.

The balustrade 6 according to FIG. 2 differs from that according to FIG. 1 in that the bar 8 is arranged to be offset inwardly relative to the handrail 7 by the spacers 12. Theoretically, the bar 8 could—as in FIG. 1—extend in the same vertical plane as the posts and handrail or be mounted directly laterally on the posts without use of an intermediate member, Notwithstanding the inwardly offset bar 8 persons have sufficient space on the car roof 5. The car roof is readily accessible below the bar for specific work. This applies particularly to the region on the car roof 5 between bar 8 and handrail 7. Engineering personnel can, for example, place toolboxes or the like in this region. Depending on the respective requirements the balustrade can additionally be equipped with a foot strip which lies on the car roof preferably in a vertical plane predetermined by the handrail 7. The foot strip (not illustrated here) would in this case thus lie approximately directly below the handrail. However, it would also be conceivable to arrange the foot strip to be offset inwardly relative to the handrail in the same manner as the bar.

Figure 3:
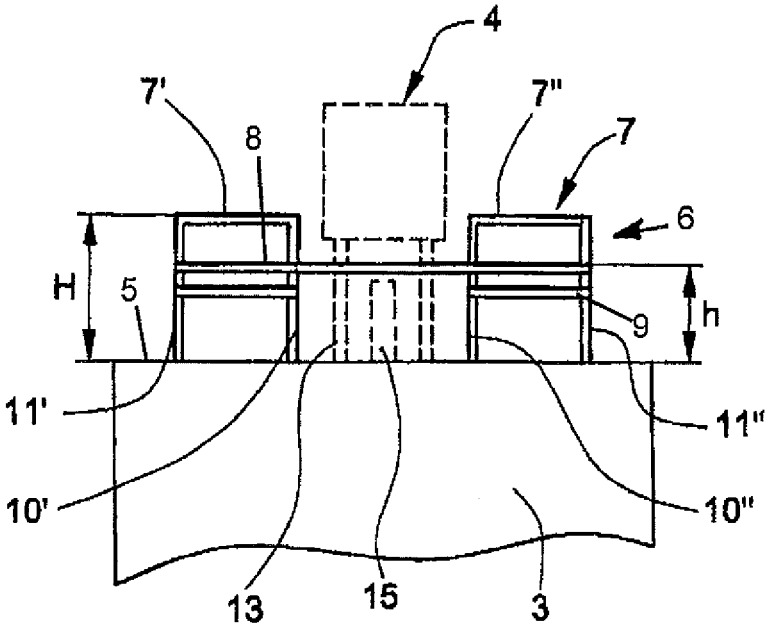
FIG. 3 shows a front view of the car of FIG. 2.

FIG. 3 shows a view of an elevator with the elevator car according to the invention from the front. The elevator comprises support means 13 for supporting the car, which are guided in vertical direction along the shaft wall associated with the drive unit 4. In addition, for example, a guide rail indicated by 15 for guiding the car can be seen. The two support means 13 which are present by way of example as well as the guide rail 15 face the drive receiving region and are covered by this. Since the support means 13 and guide rails 15 lie, with respect to the front view, in the drive receiving region for reception of the drive unit 4 these components 13, 15 associated with the shaft can take over a function of protection against falling down. The overall height of the balustrade 6, i.e. the height measured from the car roof 5 to the handrail 7, is denoted by H. The intermediate rods 9 lie at approximately half height (H/2). The bar 8 spaced from the car roof 5 by a spacing h is, as apparent, arranged to be higher than the intermediate rods 9 (h>H/2).

Figure 4:
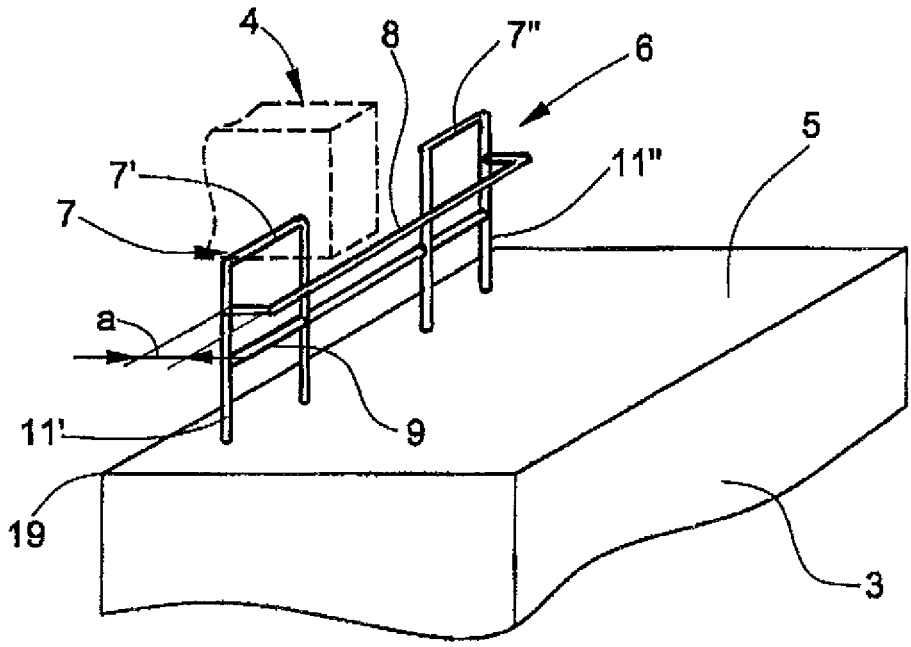
FIG. 4 shows a variant of the elevator of FIG. 3.

FIG. 4 shows an elevator which is modified by comparison with the foregoing exemplifying embodiment and which essentially differs in that the intermediate rods 9 extend entirely over the entire width. Instead of the three intermediate rods 9, which are shown in FIG. 4, and in which the outer intermediates rods connect the outer ones with the inner posts and a middle intermediate rod connects the two inner posts together, it would also be conceivable to provide a continuous intermediate rod, In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator with a car movable in an elevator shaft and having a car roof, a drive unit for moving the car, the drive unit being arranged in a region of a shaft head in the elevator shaft and projecting at least partly over the car roof, comprising:

a balustrade arranged on the car roof adjacent an edge of the car roof at a side of the car facing toward the drive unit, the balustrade including a horizontally extending handrail that has formed therein an interruption that is configured to receive a portion of the drive unit when the car is positioned at the shaft head and further including a bar connected directly to the balustrade, extending horizontally completely across the interruption and being positioned below at least one handrail section of the handrail.

2. The elevator according to claim 1 wherein the bar is offset inwardly-relative to the handrail away from the side of the car facing toward the drive unit.

3. The elevator according to claim 1 wherein the balustrade includes at least one intermediate rod positioned between the at least one handrail section and the car roof and extending parallel to the bar.

4. The elevator according to claim 3 wherein the at least one intermediate rod is positioned at approximately half a height of the handrail.

5. The elevator according to claim 3 wherein the bar is positioned higher relative to the car roof than the at least one intermediate rod.

6. The elevator according to claim 1 wherein the balustrade includes a first inner post and a second outer post positioned on one side of the interruption and the at least one handrail section extends between the first inner post and the second outer post, wherein the balustrade includes a second inner post and a second outer post positioned on an opposite side of the interruption and another handrail section that extends between the second inner post and the second outer post, and wherein the interruption lies between the first and second inner posts and the bar is fastened to the first and second outer posts.

7. The elevator according to claim 6 wherein the bar is connected with the first and second outer posts by respective spacer members.

8. The elevator according to claim 7 wherein the spacer members extend transverse to the bar.

9. The elevator according to claim 1 including a support means in operative connection with the drive unit for supporting the car, the support means being guided in vertical direction along a shaft wall of the elevator shaft at which the drive unit is positioned, and wherein the interruption is aligned with the support means.

10. The elevator according to claim 1 including at least one guide rail arranged at a shaft wall of the elevator shaft at which the drive unit is positioned for guiding at least one of the car and a counterweight, and wherein the interruption is aligned with the at least one guide rail.

11. A car for an elevator, the car being movable in an elevator shaft by a drive unit being arranged in a region of a shaft head in the elevator shaft, comprising:

a car roof of the car wherein the drive unit projects at least partly over the car roof; and a balustrade positioned on the car roof adjacent an edge of the car roof at a side of the car facing toward the drive unit, the balustrade having a handrail with an interruption formed therein, the interruption being configured to receive a portion of the drive unit when the car is positioned at the shaft head, and the balustrade having a bar connected directly to the balustrade, extending horizontally completely across the interruption and offset downwardly relative to the handrail.

12. The car according to claim 11 wherein the bar is offset inwardly relative to the handrail away from the side of the car facing toward the drive unit.

13. The car according to claim 11 wherein the balustrade includes a pair of intermediate rods positioned on opposite sides of the interruption, each of the intermediate rods being positioned between the handrail and the car roof and extending parallel to the bar.

14. The car according to claim 13 wherein the intermediate rods are positioned at approximately half a height of the handrail above the car roof.

15. The elevator according to claim 13 wherein the bar is positioned higher relative to the car roof than the intermediate rods.

16. An elevator with a car movable in an elevator shaft and having a car roof, a drive unit for moving the car, the drive unit being arranged in a region of a shaft head in the elevator shaft and projecting at least parily over the car roof, comprising:

a balustrade arranged on the car roof adjacent an edge of the car roof at a side of the car facing toward the drive unit, the balustrade including, a horizontally extending handrail that has formed therein an interruption that is configured to receive a portion of the drive unit when the car is positioned at the shaft head, a bar extending across the interruption and being positioned below at least one handrail section of the handrail, a first inner post and a second outer post positioned on one side of the interruption and the at least one handrail section extending between the first inner post and the second outer post, a second inner post and a second outer post positioned on an opposite side of the interruption and another handrail section that extends between the second inner post and the second outer post, and wherein the interruption lies between the first and second inner posts and the bar is fastened to the first and second outer posts.

17. The elevator according to claim 16 wherein the bar is connected with the first and second outer posts by respective spacer members.

18. The elevator according to claim 17 wherein the spacer members extend transverse to the bar.

* * * * *